US010392224B2

(12) United States Patent
Peterson et al.

(10) Patent No.: US 10,392,224 B2
(45) Date of Patent: Aug. 27, 2019

(54) ELEVATOR CONTROL WITH MOBILE DEVICES

(71) Applicant: OTIS ELEVATOR COMPANY, Farmington, CT (US)

(72) Inventors: Eric C. Peterson, East Longmeadow, MA (US); Paul A. Simcik, Southington, CT (US); Ashley Chapman, Plainville, CT (US); Luis C. Encinas Carreno, Farmington, CT (US); Bradley Armand Scoville, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 516 days.

(21) Appl. No.: 15/103,109

(22) PCT Filed: Dec. 17, 2013

(86) PCT No.: PCT/US2013/075615
§ 371 (c)(1),
(2) Date: Jun. 9, 2016

(87) PCT Pub. No.: WO2015/094178
PCT Pub. Date: Jun. 25, 2015

(65) Prior Publication Data

US 2016/0311647 A1 Oct. 27, 2016

(51) Int. Cl.

| | |
|---|---|
| ***B66B 1/34*** | (2006.01) |
| ***B66B 1/46*** | (2006.01) |
| ***B66B 5/00*** | (2006.01) |

(52) U.S. Cl.
CPC ..... *B66B 1/468* (2013.01); *B66B 1/3461* (2013.01); *B66B 5/0012* (2013.01); *B66B 2201/402* (2013.01); *B66B 2201/4653* (2013.01)

(58) Field of Classification Search
CPC ..... B66B 1/468; B66B 1/3461; B66B 5/0012; B66B 2201/4653; B66B 2201/402
(Continued)

(56) References Cited

U.S. PATENT DOCUMENTS 6,109,396 A * 8/2000 Sirag ..... B66B 1/468 187/381
6,202,799 B1 * 3/2001 Drop ..... B66B 1/468 187/384

(Continued)

FOREIGN PATENT DOCUMENTS

CN 101065310 A 10/2007
EP 1984286 A 10/2008

(Continued)

OTHER PUBLICATIONS

Alessandro Carlotto, "Proximity Classification For Mobile Devices Using Wi-Fi Envrionment Similarity", MELT '08 Proceedings Of The First ACM International Workshop On Mobile Entity Localization And Tracking In GPS-less Environments, accessed Nov. 7, 2013, 2pg.

(Continued)

*Primary Examiner* — Anthony J Salata
(74) *Attorney, Agent, or Firm* — Cantor Colburn LLP

(57) ABSTRACT

Embodiments are directed to receiving, by a computing device including a processor, an identifier associated with a mobile device based on a passive transmission of the identifier by the mobile device, and based on the receipt of the identifier, scheduling at least one service associated with an elevator system based on an anticipated demand for the at least one service.

21 Claims, 2 Drawing Sheets

(58) Field of Classification Search
USPC ..... 187/247, 380–388, 391, 392, 393, 396
See application file for complete search history.

(56) References Cited

U.S. PATENT DOCUMENTS

| | | | | |
|---|---|---|---|---|
| 6,209,685 | B1 * | 4/2001 | Zaharia | B66B 1/468 187/381 |
| 6,382,363 | B1 * | 5/2002 | Friedli | B66B 1/468 187/384 |
| 6,397,976 | B1 * | 6/2002 | Hale | B66B 1/468 187/384 |
| 6,868,945 | B2 | 3/2005 | Schuster et al. | |
| 7,140,469 | B2 * | 11/2006 | Deplazes | B66B 1/3476 187/316 |
| 7,347,303 | B2 | 3/2008 | Kontturi et al. | |
| 7,552,800 | B2 * | 6/2009 | Puskala | B66B 1/468 187/384 |
| 7,823,700 | B2 * | 11/2010 | Boss | B66B 1/468 187/247 |
| 7,882,938 | B2 * | 2/2011 | Blackaby | B66B 1/34 187/384 |
| 8,020,672 | B2 * | 9/2011 | Lin | B66B 1/34 187/316 |
| 8,047,333 | B2 * | 11/2011 | Finschi | B66B 1/468 187/382 |
| 8,061,485 | B2 * | 11/2011 | Finschi | B66B 1/468 187/384 |
| 8,348,021 | B2 * | 1/2013 | Finschi | B66B 1/468 187/382 |
| 8,573,366 | B2 * | 11/2013 | Elomaa | B66B 1/2458 187/387 |
| 8,813,917 | B2 * | 8/2014 | Salmikuukka | B66B 1/468 187/247 |
| 8,960,373 | B2 * | 2/2015 | De Vincentis | B66B 1/2408 187/381 |
| 9,284,158 | B2 * | 3/2016 | Sarjanen | B66B 1/468 |
| 9,323,232 | B2 * | 4/2016 | Blom | H04W 4/029 |
| 9,481,548 | B2 * | 11/2016 | Siddiqui | B66B 1/2416 |
| 9,580,272 | B2 * | 2/2017 | Kappeler | B66B 1/468 |
| 9,834,408 | B2 * | 12/2017 | Fujiwara | B66B 1/468 |
| 2009/0294221 | A1 | 12/2009 | Bahjat et al. | |
| 2012/0037461 | A1 | 2/2012 | Finschi | |
| 2012/0090922 | A1 | 4/2012 | Elomaa et al. | |
| 2012/0252498 | A1 | 10/2012 | Trinchero et al. | |

FOREIGN PATENT DOCUMENTS

| | | | |
|---|---|---|---|
| WO | 2011009358 | A1 | 1/2011 |
| WO | 2011141627 | A1 | 11/2011 |
| WO | 2012059639 | A1 | 5/2012 |

OTHER PUBLICATIONS

BlipSystems.com, "BlipTrack Tracking—Privacy Concerns", downloaded from http://www.blipsystems.com/urban/privacy-concerns/ on Nov. 7, 2013, 1 page.

BlueMotion/Blooth FAQ, "InterVistas BlueMotion/Blooth, Bluetooth Monitoring for Airports", Dec. 1, 2010, downloaded from http://www.intervistas.com/downloads/BlueMotion_FAQ_08Feb2011.pdf on Nov. 7, 2013, 3 pages.

International Search Report for application PCT/US2013/075615; dated Sep. 24, 2014, pp. 1-6.

Melanie D.G. Kaplan, "Intelligent Elevators Answer Vertical Challenges", SmartPlanet.com, Jul. 17, 2012, 5 pages.

Stackoverflow.com, "Detecting Proximity Using MAC Address", downloaded from http://stackoverflow.com/questions/19641454/detecting-proximity-using-mac-address on Nov. 7, 2013, 2 pages.

Superuser.com, "Wi-Fi Client Mac Address Scanning", downloaded from http://superuser.com/questions/471450/wi-fi-client-mac-address-scanning on Nov. 7, 2013, 1 pages.

Written Opinion for application PCT/US2013/075615; dated Sep. 24, 2014, pp. 1-8.

European Search Report for application EP 13899919.8, dated Aug. 30, 2017, 9 pages.

Chinese Fourth Office Action for application CN 201380081672.3, dated Mar. 5, 2019, 10 pages.

* cited by examiner

ELEVATOR CONTROL WITH MOBILE DEVICES

BACKGROUND

Conventionally, an elevator system recognizes the existence of individual users planning to use the elevator in order to respond to demand or requests for service. Buttons, keypad devices, and touchscreen devices may be used for entering a request for elevator service. For an elevator system that utilizes a two-button (e.g., up or down button) configuration, the elevator system only recognizes that there is a request for service without any indication as to the number of people waiting to use the elevator. For an elevator system that utilizes a keypad and/or touchscreen device with destination dispatching, the elevator system recognizes the count of requests made by individual users or passengers who interact with the keypad/touchscreen device. In either case/configuration, a user/passenger engages in an affirmative action to request elevator service.

In general, an elevator system does not have a reliable count of users or passengers requesting service. For example, when people travel in groups it is common for a single person to enter a request for service. In a building where more than one elevator car or elevator system is available for potential use, an inadequate number of car calls may be made where the count of users/passengers needing elevator service exceeds the capacity of a car. This can result in an overloading of an elevator car, a rush of passengers into the elevator car, or a situation where not everyone can enter the elevator car, thus requiring an additional request for an elevator car and an additional waiting period. Additionally, access to elevator request devices may be limited, such as during peak use periods (e.g., morning or evening rush period). This creates situations where a user is delayed in making his/her individual request or being able to confirm if a hall button in his/her intended direction of travel has already been pressed.

BRIEF SUMMARY

An embodiment is directed to a method comprising: receiving, by a computing device comprising a processor, an identifier associated with a mobile device based on a passive transmission of the identifier by the mobile device, and based on the receipt of the identifier, scheduling at least one service associated with an elevator system based on an anticipated demand for the at least one service.

An embodiment is directed to an apparatus comprising: memory having instructions stored thereon that, when executed, cause the apparatus to: receive an identifier associated with a mobile device based on a passive transmission of the identifier by the mobile device, and based on the receipt of the identifier, schedule at least one service associated with an elevator system based on an anticipated demand for the at least one service.

An embodiment is directed to a conveyance system comprising: a gateway configured to receive a plurality of unique identifiers associated with a corresponding plurality of mobile devices when the mobile devices are within a threshold distance of the gateway based on a passive transmission of the identifiers by the mobile devices, and a controller coupled to the gateway, wherein the controller is configured to schedule at least one service associated with the conveyance system based on an anticipated demand for the at least one service, wherein the anticipated demand is based on a count of the identifiers.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
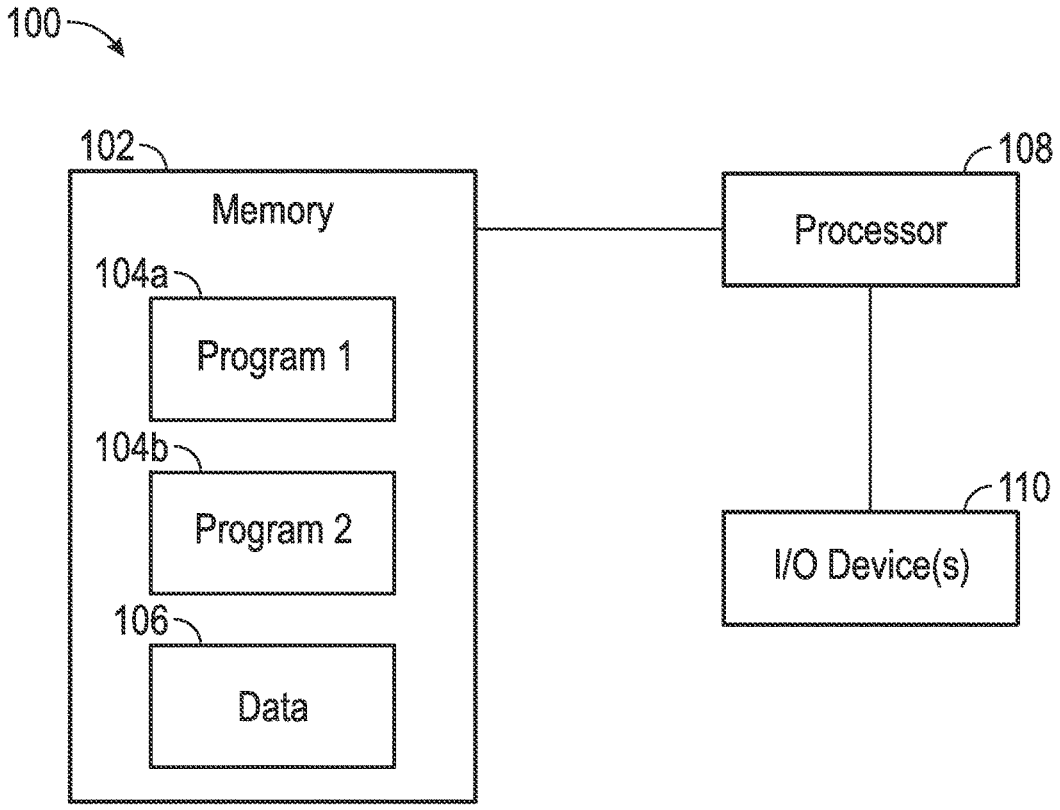
FIG. 1 is a schematic block diagram illustrating an exemplary computing system.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems, and methods are described for recognizing individuals in a location (e.g., an elevator landing area) by monitoring active mobile devices (e.g., mobile phones). In some embodiments, an identifier associated with a mobile device may be obtained and used to count the number of users waiting for service at the location. The number or count of users waiting for service may be based on a passive or hands-free technique, such that the users might not have to take any specific or affirmative action to have a request for elevator service associated with them (other than turning on the mobile device or enabling an application on the mobile device). In some embodiments, resources may be scheduled (e.g., elevator car calls may be made) based on the count of users or anticipated demand.

Referring to FIG. 1, an exemplary computing system 100 is shown. The system 100 is shown as including a memory 102. The memory 102 may store executable instructions. The executable instructions may be stored or organized in any manner and at any level of abstraction, such as in connection with one or more applications, processes, routines, procedures, methods, etc. As an example, at least a portion of the instructions are shown in FIG. 1 as being associated with a first program 104*a* and a second program 104*b*.

The memory 102 may store data 106. The data 106 may include registration data, elevator car data, a device identifier, or any other type of data.

The instructions stored in the memory 102 may be executed by one or more processors, such as a processor 108. The processor 108 may be operative on the data 106.

The processor 108 may be coupled to one or more input/output (I/O) devices 110. In some embodiments, the I/O device(s) 110 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 110 may be configured to provide an interface to allow a user to interact with the system 100.

Figure 2:
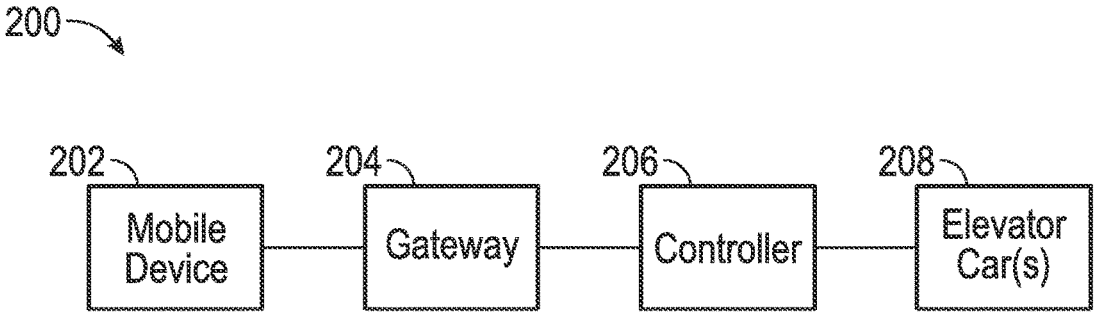
FIG. 2 illustrates a block diagram of an exemplary elevator system.

Turning now to FIG. 2, an exemplary system 200 in accordance with one or more embodiments is shown. The system 200 may be implemented in connection with one or more components, devices, or other systems (e.g., system 100). The system 200 may be associated with an elevator system. The system 200 may be used to detect the presence of a user, or more specifically, a mobile device. The detected presence of the user may be used as a basis for determining a demand for elevator service.

The system 200 may include a mobile device 202, such as a phone, a laptop, a tablet, etc. The mobile device 202 may include an identifier that may distinguish the mobile device 202 from other devices. For example, the identifier may be a media access control (MAC) address, a BLUETOOTH wireless technology Address, an International Mobile Station Equipment Identity (IMEI), an International Mobile Subscriber Identity (IMSI), etc. The mobile device 202 may be associated with (e.g., owned by) a particular user. While a single mobile device 202 is shown in FIG. 2, more than one mobile device 202 may be present in some embodiments.

The system 200 may include a gateway 204. The gateway 204 may include one or more of a router (e.g., wireless router), an access point, a receiver (e.g., a WiFi receiver), etc. The gateway 204 may be located inside an elevator car (e.g., elevator car(s) 208), in proximity to an elevator landing, at points of egress to a building, and/or outside of the building. While a single gateway 204 is shown in FIG. 2, more than one gateway 204 may be present in some embodiments.

The gateway 204 may be configured to communicate with the mobile device 202. For example, the gateway 204 may obtain the identifier associated with the mobile device 202 as part of the communication. The gateway 204 may communicate the presence of the user or the mobile device 202 to a controller 206. The controller 206 may generate one or more commands to facilitate elevator service for a user associated with the mobile device 202. For example, the commands may be used to direct the one or more elevator cars 208. The commands may be based on a profile associated with the user or the mobile device 202 as described in further detail below.

The systems 100 and 200 are illustrative. In some embodiments, one or more of the entities may be optional. In some embodiments, additional entities not shown may be included. For example, in some embodiments the systems 100 and/or 200 may be associated with one or more networks, such as one or more computer or telephone networks. In some embodiments, the entities may be arranged or organized in a manner different from what is shown in FIGS. 1-2.

As described above, one or more gateways 204 may be in proximity to an elevator landing, at points of egress to a building, and/or outside of the building. Placing the gateway(s) in such locations may be used to schedule or place elevator car calls based on communication between the gateway(s) 204 and mobile device(s) 202. For example, a count of mobile device(s) 202 that are in communication with (e.g., proximate to) the gateway(s) 204 may be used as a basis for predicting elevator service demand, such that an appropriate count of elevator cars can be summoned to a particular floor or landing. Such communication between the mobile device(s) 202 and the gateway(s) 204 may be used to reduce the impact of a large number of users or crowds entering a building at once or leaving the building (or a particular floor/landing) at the same time.

In terms of alleviating demand for service in connection with a crowd or large number of users, the system (e.g., the controller 206) may store data pertaining to building traffic in order to schedule appropriate elevator services to match anticipated demand. Such services may include commanding elevator cars 208 to particular floors or landings, potentially as a function of a day of the week or the time of day.

As described above, a gateway 204 may be located inside an elevator car 208. Locating a gateway 204 inside the elevator car 208 may be used as a basis for confirming that a user or the mobile device 202 has actually entered the elevator car 208, thereby fulfilling the (presumed) service request. If the user did not enter the elevator car 208, a subsequent car call or request for service may be entered by, e.g., the controller 206 on behalf of the user/mobile device 202. Such a subsequent car call may be used if, e.g., the user elected not to enter the first arriving elevator car 208 that was available to take the user to the user's destination floor/landing. In some embodiments, a timeout or counter may be used such that if a user fails to enter 'n' number of cars 208 in a given period of time, future car calls/requests will not be entered for the user (for a specified period of time). In this manner, the elevator system can avoid allocating elevator cars 208 to a user/mobile device 202 that has demonstrated behavior suggesting a lack of intention to use the elevator system.

As described above, in some embodiments a profile may be associated with a particular mobile device 202. The profile may be associated with the particular mobile device 202 based on the identifier associated with the mobile device 202. The profile may be generated or populated on the basis of a user of the mobile device 202 completing a registration process. The registration process may be based on the use of a website or kiosk. The registration process may be conducted remotely from a building housing an elevator or the registration process may be conducted in connection with the mobile device 202 communicating with, e.g., the gateway 204 or the controller 206.

Once a profile for a user is established, the user's historical patterns of elevator usage may be monitored or tracked. As part of such monitoring/tracking, a suggested or default destination may be entered in the profile, such that when the mobile device 202 associated with that user is in communication with a gateway 204 a default destination floor or landing may be selected for the user. The default destination floor may be selected as a function of the day of the week, the time of day, other user preferences, etc. The default destination floor or other parameters associated with a profile may be presented to the user, potentially as a request sent to the mobile device 202 that requests the user to register the mobile device 202 or the profile. The user may have the ability to override the default destination floor or other parameters, either permanently (e.g., as part of an update to the profile or as part of the registration process) or on, e.g., a one-time basis.

The profile may include a nickname for a user of a particular mobile device 202. The nickname may be selected by the user (e.g., as part of a registration process) or may be assigned and provided to the user by a service provider or operator. A database of nicknames may be maintained by the service provider or operator to ensure that each nickname is unique or is only used once. The nickname may be presented on a sign or audio device located proximate to a plurality of elevator cars. Data presented by the sign or audio device may indicate that the user associated with the nickname should enter a particular elevator car for elevator service. In this manner, the elevator system may make decisions to maximize the efficiency or use of the elevator system (e.g., minimizing power consumed, minimizing the number of stops at floors or landings, etc.). Moreover, the user's actual name or identity may be concealed or not revealed, allowing the user to know which elevator car to enter while still allowing the user to remain anonymous. Furthermore, the user might not need to take the mobile device 202 out of, e.g., her pocket, backpack, briefcase, purse, etc.

In some embodiments, feedback or directives may be provided to the mobile device 202. For example, data may be provided to the mobile device 202 that directs a user of the mobile device 202 to enter a particular elevator car 208 for elevator service.

Figure 3:
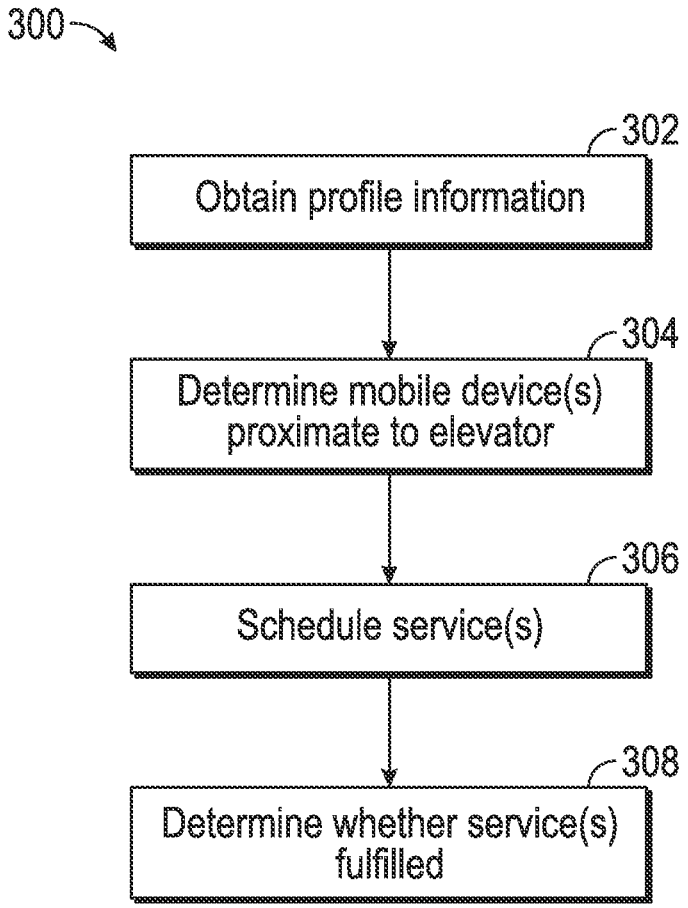
FIG. 3 illustrates a flow chart of an exemplary method.

Referring now to FIG. 3 a flowchart of a method 300 is shown that may be used in connection with one or more entities, devices or systems, such as those described herein. The method 300 may be used to provide a passive or hands-free experience in obtaining elevator service.

In block 302, profile information may be obtained. The profile information may be obtained as part of a registration process. The profile information may include one or more of: an identifier associated with a mobile device, a nickname associated with the mobile device or a user of the mobile device, preferences associated with a user of the mobile device, patterns of usage of an elevator system, etc.

In block 304, a determination may be made that one or more mobile devices are proximate to (e.g., within a threshold distance of) an elevator system. The determination may be based on a communication of identifier(s) associated with the mobile device(s) to one or more gateways. The gateway(s) may receive the identifier(s) from the mobile device(s).

In block 306, one or more services may be scheduled for user(s) of the mobile device(s) based on the determination of block 304. For example, a car call may be made for one or more elevator cars. The service(s) may be selected based on the profile of block 302. The service(s) may be scheduled based on anticipated demand (e.g., number of mobile devices in proximity to the elevator system plus any affirmative requests for service).

In block 308, a determination may be made whether the service(s) scheduled for the user(s) in block 306 have been fulfilled. If the service(s) have been fulfilled, the service(s) may be canceled from a pending queue. Otherwise, the service(s) may remain pending in the queue or may be rescheduled as necessary, potentially subject to a timeout or maximum number of retries.

In some embodiments, as part of block 308 a determination may be made whether a user or mobile device exits an elevator at an appropriate floor or destination. As part of that determination, a notification may be provided when a user or mobile device does not get out at the right floor or gets off at the wrong floor. The notification may be provided to the user or the mobile device, a building owner, security personnel, etc. The notification may be communicated to a number of entities or devices. The notification may take one or more forms, such as a sound/auditory message or alert, a displayed message or graphic, etc. The notification may be provided in an elevator car, in a hallway proximate to the elevator car or hoistway, or in any other location.

The method 300 is illustrative. In some embodiments, one or more of the blocks or operations (or portions thereof) may be optional. In some embodiments, additional operations not shown may be included. In some embodiments, the operations may execute in an order or sequence different from what is shown.

As described herein, in some embodiments elevator cars may be allocated or re-allocated in order to meet anticipated demand for service. A count of users that are likely to need elevator service may be based on one or more identifiers that are transmitted by mobile devices.

In some embodiments, an explicit request for elevator service might not be entered. For example, a request for elevator service may be inferred based on a transmission of an identifier associated with a mobile device.

In some embodiments, existing infrastructure (e.g., elevator system infrastructure) may be used, thereby reducing a cost of implementation or deployment. In some embodiments, a number of elevator systems located in a number of buildings may be configured to detect the presence of the same mobile device. Accordingly, a user may use the same mobile device to access resources associated with various elevator systems.

Aspects of the disclosure may be used to place an elevator car call on behalf of a user. If a profile (e.g., a registered profile) is available, a destination floor or landing may be selected for a user.

Aspects of the disclosure may be used to maintain a user's privacy or anonymity. For example, receipt of a mobile device identifier or indicator by an elevator system allows the elevator system to schedule resources without necessarily knowing the identity of the user of the mobile device. Furthermore, customized services can be provided to the user in connection with a profile, again without requiring specific knowledge as to the identity of the user of the mobile device.

Aspects of the disclosure may be used in connection with one or more data mining applications. For example, patterns of elevator usage may be analyzed to suggest alternative times that users could consume elevator resources. Advertising opportunities may be available. For example, if a user profile indicates that the user likes to drink coffee, coupons for free coffee may be provided to the user as an incentive to utilize the elevator during off-peak times or periods.

While some of the examples described herein related to elevator systems, aspects of this disclosure may be applied in connection with other types of conveyance devices and systems, such as a dumbwaiter, an escalator, a moving sidewalk, a wheelchair lift, etc.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. In some embodiments, digital logic circuits or devices (e.g., field programmable gate arrays (FPGAs), programmable logic devices (PLDs), etc.) may be used. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

receiving, by a computing device comprising a processor, an identifier associated with a mobile device based on a passive transmission of the identifier by the mobile device;

based on the receipt of the identifier, scheduling at least one service associated with an elevator system based on an anticipated demand for the at least one service;

fulfilling the at least one service associated with the elevator system after determining that the mobile device has entered an elevator car.

2. The method of claim 1, wherein the identifier comprises at least one of: a media access control (MAC) address, a BLUETOOTH wireless technology Address, an International Mobile Station Equipment Identity (IMEI), and an International Mobile Subscriber Identity (IMSI).

3. The method of claim 1, further comprising:

cancelling the at least one service from a pending queue based on determining that the at least one service has been completed by a user of the mobile device.

4. The method of claim 1, further comprising:

rescheduling the at least one service based on determining that the at least one service has not been completed by a user of the mobile device.

5. The method of claim 1, wherein the anticipated demand is based on receipt of a plurality of identifiers associated with a plurality of mobile devices, and wherein the identifier is included in the plurality of identifiers, and wherein the mobile device is included in the plurality of mobile devices.

6. The method of claim 1, wherein the anticipated demand is based on at least one affirmative request for the at least one service.

7. The method of claim 1, wherein scheduling the at least one service comprises placing a car call for an elevator car to arrive at a first landing.

8. The method of claim 7, further comprising:

determining that the mobile device enters the elevator car at the first landing; and causing the elevator car to go to a second landing based on a profile associated with the identifier.

9. The method of claim 1, further comprising:

monitoring traffic patterns associated with the mobile device; and generating, based on the monitored traffic patterns, a suggested profile for a user during a registration process.

10. An apparatus comprising:

memory having instructions stored thereon that, when executed, cause the apparatus to:

receive an identifier associated with a mobile device based on a passive transmission of the identifier by the mobile device;

based on the receipt of the identifier, schedule at least one service associated with an elevator system based on an anticipated demand for the at least one service;

fulfill the at least one service associated with the elevator system after determining that the mobile device has entered an elevator car.

11. The apparatus of claim 10, wherein the identifier comprises at least one of: a media access control (MAC) address, a BLUETOOTH wireless technology Address, an International Mobile Station Equipment Identity (IMEI), and an international Mobile Subscriber Identity (IMSI).

12. The apparatus of claim 10, wherein the anticipated demand is based on receipt of a plurality of identifiers associated with a plurality of mobile devices, and wherein the identifier is included in the plurality of identifiers, and wherein the mobile device is included in the plurality of mobile devices.

13. The apparatus of claim 10, wherein the anticipated demand is based on at least one affirmative request for the at least one service.

14. The apparatus of claim 10, wherein the instructions, when executed, cause the apparatus to:

place a car call for an elevator car to arrive at a first landing.

15. The apparatus of claim 14, wherein the instructions, when executed, cause the apparatus to:

determine that the mobile device enters the elevator car at the first landing; and cause the elevator car to go to a second landing based on a profile associated with the identifier.

16. The apparatus of claim 10, wherein the instructions, when executed, cause the apparatus to:

schedule the at least one service based on a profile associated with the identifier.

17. The apparatus of claim 16, wherein the profile comprises at least one preference specified by a user of the mobile device during a registration process.

18. A conveyance system comprising:

a gateway configured to receive a plurality of unique identifiers associated with a corresponding plurality of mobile devices when the mobile devices are within a threshold distance of the gateway based on a passive transmission of the identifiers by the mobile devices; and a controller coupled to the gateway, wherein the controller is configured to schedule at least one service associated with the conveyance system based on an anticipated demand for the at least one service, wherein the anticipated demand is based on a count of the identifiers the controller configured to fulfill the at least one service associated with the elevator system after determining that the mobile device has entered an elevator car.

19. The conveyance system of claim 18, wherein the controller comprises at least one profile associated with at least one of the identifiers, and wherein the at least one service is customized in accordance with a parameter specified in the profile.

20. The conveyance system of claim 18, wherein the conveyance system comprises an elevator, and wherein the gateway is located in at least one of: a hallway located within a threshold distance of an elevator car and within the elevator car.

21. The conveyance system of claim 18, wherein the controller is configured to provide a first notification when a first mobile device does not exit the conveyance system at a first floor scheduled as a first destination for the first mobile device, and wherein the controller is configured to provide a second notification when a second mobile device exits the conveyance system at a second floor that is not scheduled as a second destination for the second mobile device.

* * * * *